US009377012B2

(12) United States Patent
Burnette

(10) Patent No.: US 9,377,012 B2
(45) Date of Patent: Jun. 28, 2016

(54) HIGH PRESSURE PUMP

(71) Applicant: Blake C. Burnette, Tomball, TX (US)

(72) Inventor: Blake C. Burnette, Tomball, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 501 days.

(21) Appl. No.: 13/852,274

(22) Filed: Mar. 28, 2013

(65) Prior Publication Data

US 2014/0290956 A1 Oct. 2, 2014

(51) Int. Cl.

| | |
|---|---|
| ***F04B 17/00*** | (2006.01) |
| ***F02B 71/04*** | (2006.01) |
| ***E21B 43/26*** | (2006.01) |
| ***E21B 41/00*** | (2006.01) |

(52) U.S. Cl.

CPC ..... *F04B 17/00* (2013.01); *E21B 41/00* (2013.01); *E21B 43/26* (2013.01); *F02B 71/045* (2013.01)

(58) Field of Classification Search

CPC .... F04B 17/00; F04B 15/00; F04B 2015/026; F04B 47/12; F02B 71/045; E21B 43/12; E21B 43/121; E21B 47/007; E21B 43/26; E21B 41/00

See application file for complete search history.

(56) References Cited

U.S. PATENT DOCUMENTS

| | | | | |
|---|---|---|---|---|
| 3,149,773 | A | | 9/1964 | Cudahy |
| 3,182,895 | A | * | 5/1965 | Panhard ..... 417/340 |
| 3,260,213 | A | | 7/1966 | Eickmann |
| 3,986,796 | A | | 10/1976 | Moiroux et al. |
| 4,097,198 | A | | 6/1978 | Herron |
| 4,140,440 | A | | 2/1979 | Ferris |
| 4,599,861 | A | | 7/1986 | Beaumont |
| 5,297,631 | A | * | 3/1994 | Gipson ..... 166/299 |
| 5,702,238 | A | | 12/1997 | Simmons et al. |
| 6,241,488 | B1 | | 6/2001 | Luoto |
| 6,293,231 | B1 | | 9/2001 | Valentin |
| 6,470,677 | B2 | | 10/2002 | Bailey |
| 6,484,674 | B2 | | 11/2002 | Valentin |
| 6,551,076 | B2 | | 4/2003 | Boulware |
| 2005/0265859 | A1 | | 12/2005 | Hansen et al. |
| 2007/0209615 | A1 | | 9/2007 | Epshteyn |

OTHER PUBLICATIONS

Retrieved from the internet http://www.netl.doe.gov/kmd/cds/disk28/NG10-3.PDF; [retrieved on Jun. 12, 2013]; S. Veenhuizen et al., "High Pressure Downhole Pump Jet-Assist Drilling," 10 pages.

* cited by examiner

*Primary Examiner* — Yong-Suk (Philip) Ro
(74) *Attorney, Agent, or Firm* — Cantor Colburn LLP

(57) ABSTRACT

A pump assembly including a plunger in communication with a pumpable media, a plurality of combustion chambers and a plurality of pistons. Each piston is associated with one of the combustion chambers. The pistons are in communication with the plunger and operatively arranged to together collectively urge the plunger in a pumping direction when the combustion chambers are triggered for displacing the pumpable media with the plunger. A method of pumping a media.

19 Claims, 1 Drawing Sheet

HIGH PRESSURE PUMP

BACKGROUND

Pumps are utilized in the downhole drilling and completions industry for a variety of purposes, notably, the performance of various fluid treatments. In hydraulic fracturing, for example, a fluid or slurry is pumped at high pressures downhole to initiate and force open cracks in a downhole formation in order to promote the production of hydrocarbons from the downhole formation. Due largely to the popularity of hydraulic fracturing and the performance of other downhole fluid treatment operations, the industry always well receives new and alternate pumping systems, particularly where gains in reliability and efficiency can be realized.

SUMMARY

A pump assembly, including a plunger in communication with a pumpable media; a plurality of combustion chambers; and a plurality of pistons, each piston associated with one of the combustion chambers, the pistons in communication with the plunger and operatively arranged to together collectively urge the plunger in a pumping direction when the combustion chambers are triggered for displacing the pumpable media with the plunger.

A method of pumping a media, including firing at least one of a plurality of combustion chambers, each combustion chamber associated with a corresponding one of a plurality of pistons; urging, in an actuation direction due to the firing, each of the pistons corresponding to each of the combustion chambers that is fired; exerting a force on a plunger in a pumping direction collectively with each of the pistons that is urged in the actuation direction; moving the plunger in the pumping direction with the force; and pumping a media with the plunger.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
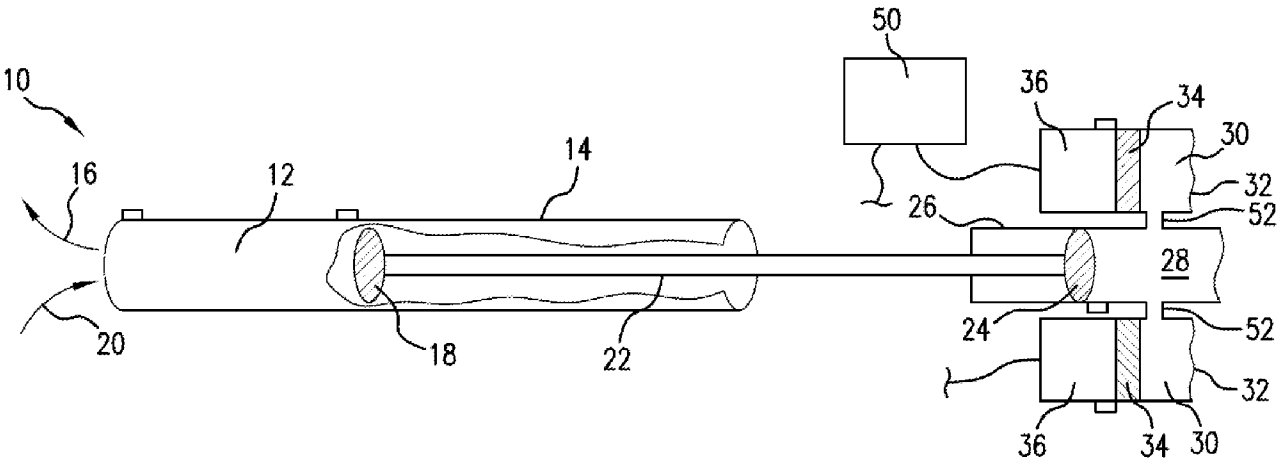
FIG. 1 schematically shows a pump assembly according to one embodiment disclosed herein.

Referring now to FIG. 1, an assembly 10 is illustrated for enabling a pumpable media to be pumped. By pumpable media it is meant that the media is able to be pumped from one location to another by the assembly 10. For example, in one embodiment, the pumpable media is a fluid or other flowable material, e.g., a plurality of solid particles that together behave in a flowable or fluid-like manner (e.g., proppants), or a combination of the foregoing (e.g., a slurry).

The pumpable media is initially contained in a pump chamber 12 of a pump cylinder 14 and forced out of the chamber 12 via an outlet 16 by movement of a plunger 18 within the pump cylinder 14. It is to be appreciated that the term cylinder is utilized merely as pistons and plungers conventionally take circular cross-sections, but that any other cross-sectional shape of plunger, piston, housing, and chamber could be utilized. The media enters the pump chamber 12 via an inlet 20 when the chamber 12 enlarges due to the plunger 18 moving in an exhaust stroke away from the outlet 16 and the inlet 20. The outlet 16 and the inlet 20 may be equipped with check valves to ensure the media flows in only the desired direction from the inlet 20 into the chamber 12 and out via the outlet 16.

The plunger 18 is connected by a rod 22 to a primary piston 24. As will be better appreciated in view of the below disclosure, the rod 22 could be replaced by other couplings, including non-mechanical, e.g., hydraulic, couplings. The primary piston 24 is movable within a cylinder 26, which includes a common chamber 28 that is in fluid communication with a plurality of working chambers 30 of corresponding actuation cylinders 32. Two of the actuation cylinders 32 are shown in FIG. 1, although it is to be appreciated that any number of actuation cylinders could be included as desired having working chambers in communication with the common chamber 28.

Figure 2:
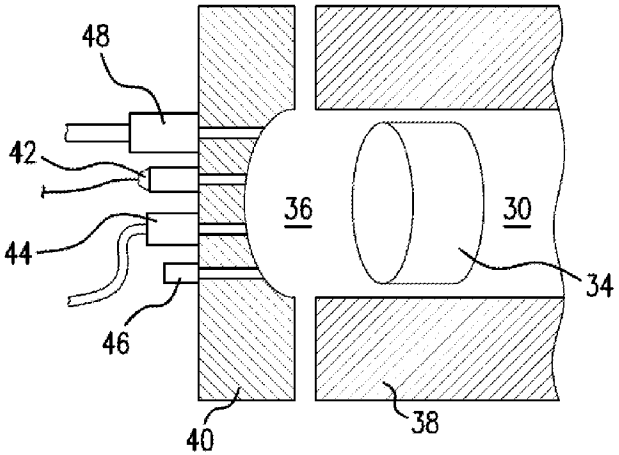
FIG. 2 schematically shows a cross-section of a combustion chamber that is usable in the pump assembly of FIG. 1.

Each of the actuation cylinders 32 includes a piston 34 that is reciprocal within the cylinders 32. A combustion chamber 36 is included opposite the working chambers 30 for enabling actuation of the corresponding pistons 34. In one embodiment, the pistons 34 are activated by igniting a combustible fluid mixture within the chamber 36. For example, one embodiment of the combustion chamber 36 is shown in more detail in FIG. 2. In the embodiment shown in FIG. 2, the combustion chamber 36 is formed by a block 38 and a head 40 of the cylinder 32, although other housing components could be used. The chamber 36 may generally resemble that of a conventional automobile engine. In the illustrated embodiment, the chambers 36 are supplied with a combustible fuel, e.g., hydrocarbon-based fuel, via a fuel injector 42 and air via an air injector 44, in order to create a combustible mixture. An igniter 46 is provided to fire the chambers 36 by triggering combustion of the combustible mixture. An exhaust valve 48 enables the chamber 36 to be emptied of exhaust gases between each combustion cycle.

In the illustrated embodiment, the injectors 42 and 44, igniter 46, and valve 48, or combinations thereof, are communicably coupled with and controlled by a control unit 50. The control unit 50 may take the form of a computerized device and may include a memory, a processor or logic unit, sensors for monitoring emissions, performance of the assembly 10, position of the piston 34, and any other suitable components for interfacing the control unit 50 with the aforementioned components of the combustion chamber 36 and/or with operators of the pump assembly 10. For example, many current automobile engines have fuel and air injectors, igniters, and/or exhaust valves that are electronically controlled and monitored by a computer device, and any such devices could be used as, for, or with the control unit 50.

Combustion causes a sudden expansion of fluids within the chamber 36, thereby moving the pistons 34 and enlarging the chamber 36. This results in the chambers 30 decreasing in size, which results in the pressurization of fluid within the common chamber 28 due to a port 52 enabling fluid communication between the common chamber 28 and each the chambers 30. By using a suitable working fluid, e.g., an essentially incompressible liquid, in the common chamber 28, force exerted on the working fluid from each of the pistons 34 due to combustion will be transferred via the working fluid on the primary piston 24. By exerting a suitably high force, the piston 24 will force the plunger 18 to displace the pumpable media out of the chamber 12 to a desired location. The working fluid in the common chamber 28 in one embodiment is an oil or lubricant for advantageously cooling the cylinders 26 and 32, lubricating the movement of the pistons 24 and 34, etc.

In one embodiment, the pumpable media is pumped into a borehole for performance of a downhole treatment, stimulation, or operation, such as actuation of a tool, valve, or sleeve. In a particular embodiment, the downhole treatment or operation involves hydraulic fracturing. For example, the pump assembly 10 can be in fluid communication with a tubular string run through a borehole. It is to of course be appreciated that the pump assembly 10 could alternatively be in fluid communication with an annulus between the wall of the borehole and the string if desired. In one embodiment, a zone or interval along a length of the tubular string and the borehole is desired to be treated, e.g., fractured, in order to facilitate the production of hydrocarbons from a downhole formation through which the borehole is drilled. One or more screen assemblies (including mesh, wire-wrap, slotted tubulars, fluid permeable foam, etc.) may be positioned proximate to the zone for permitting the production of fluids while obstructing the production of sand and debris. The zone may be flanked by a set of packer or seal assemblies that deploy or engage against the wall of the borehole for isolating the zone, e.g., thereby enabling high pressure fluid from the pump assembly 10 to be directed into the zone. The tubular string may include a cross-over assembly, suitable valves, etc., to enable the pumped media, e.g., a proppant slurry, treatment chemicals, etc., to be pumped into the annulus proximate to the zone in order to fracture the zone or otherwise treat or stimulate the zone. The pump assembly 10 may be utilized for treating multiple discrete zones (e.g., separated by packer assemblies) in this manner along the length of the borehole.

In one embodiment, the control unit 50 is arranged not only to regulate the operation of the combustion chambers 36 as detailed above, but also to alter operation of the assembly 10 as a whole. In one embodiment, the control unit 50 determines or calculates how many of the combustion chambers 34 will fire, e.g., in response to the measured and/or desired pressure of the pumped media, which may be monitored via sensors disposed with the assembly 10, with or within the cylinders 14, 26, and 32, located along the tubular string with which the assembly 10 is used, with screen assemblies, etc. That is, with knowledge of the force generated by each of the combustion chambers 36, the control unit 50 can automatically react to sensed conditions and fire or trigger a greater number of combustion chambers as the measured pressure increases, or scale down the number of the combustion chambers that are fired as pressure decreases. In this way, the control unit 50 can enable the assembly 10 to automatically react to changing conditions in order to maintain a high level of efficiency without sacrificing performance. Position sensors for the plunger 18, primary piston 24, pistons 34, etc. may also be communicably coupled with the control unit 50 to assist in the operation of the combustion chambers 36 and/or to determine the number of chambers 36 that are fired for each stroke of the plunger 18. The control unit 50 could also receive input from operators such that the operators are able to change parameters to make the assembly 10 to fire a desired number of combustion chambers 36, to set or affect the parameters or parameter ranges that the control unit 50 utilizes to determine how many combustion chambers 36 to fire, to set the fuel/air ratio of the combustible mixture provided to the chambers 36, etc.

It is to be appreciated with respect to the illustrated embodiments that powering a single pump plunger, e.g., the plunger 18, with multiple combustion chambers, e.g., the chambers 36, benefits in addition to increased pumping pressure, as noted above, can be achieved. For example, if a particulate laden fluid or slurry is utilized as the pumpable media, there is a concern that sand, grit, or other solids could wedge between plunger 18 and the wall of the cylinder 14, damaging the cylinder 14, the plunger 18, a dynamic seal positioned therebetween, etc. For this reason, it is desired to minimize the number of strokes that the plunger 18 must take to pump a given amount of media is desired and thus, maximize the length of the strokes. The pistons 34 are not subjected to such solids or debris, and thus will not suffer as much wear as the plunger 18. Thus, the pistons 34 can be set to collectively act together to produce a longer stroke length for the plunger 18 than of each individual one of the pistons 34, to reciprocate multiple times to complete a single stroke of the plunger 18 (the control unit 50 may need to control the status of the inlet 16 in such an embodiment to avoid the in-rush of fluid from interfering with each stroke of the plunger 18), etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A pump assembly, comprising:

a plunger in communication with a pumpable media;

a plurality of combustion chambers; and a plurality of pistons, each piston of the plurality of pistons associated with one of the combustion chambers, the pistons in communication with the plunger and operatively arranged to together collectively urge the plunger in a pumping direction as the plurality of combustion chambers are simultaneously fired for displacing the pumpable media with the plunger.

2. The pump assembly of claim 1 wherein all of the combustion chambers in the plurality of combustion chambers are fired and all of the pistons in the plurality of pistons together collectively urge the plunger in the pumping direction.

3. The pump assembly of claim 1 wherein the plurality of pistons include a hydraulic coupling to a primary piston.

4. The pump assembly of claim 3, further comprising the primary piston mechanically coupled to the plunger, the plurality of pistons coupled to the plunger via the primary piston.

5. The pump assembly of claim 1, further comprising a control unit operatively arranged for controlling operation of the pump assembly.

6. The pump assembly of claim 5, wherein the control unit controls firing of the plurality of combustion chambers.

7. The pump assembly of claim 5, wherein the control unit determines a number of the combustion chambers to fire, the number ranging from at least one of the combustion chambers to all of the combustion chambers in the plurality of combustion chambers.

8. The pump assembly of claim 7, wherein the control unit compares a force generated by each combustion chamber to a pressure required to pump the pumpable media in order to determine the number.

9. The pump assembly of claim 8, wherein the pressure is measured and communicated to the control unit.

10. The pump assembly of claim 8, wherein the pressure is entered into the control unit by an operator.

11. A downhole system including the pump assembly of claim 1 coupled with a tubular string run through a borehole.

12. The system of claim 11, wherein the pumpable media is configured to treat or stimulate a zone of a downhole formation.

13. The system of claim 12, wherein the pumpable media includes a proppant slurry and the downhole formation is hydraulically fractured by pumping the pumpable media with the pump assembly.

14. A method of pumping a media, comprising:

firing at least one of a plurality of combustion chambers, each combustion chamber associated with a corresponding one of a plurality of pistons;

urging, in an actuation direction due to the firing, each of the pistons corresponding to each of the combustion chambers that is fired;

exerting a force on a plunger in a pumping direction collectively with the each of the pistons that is urged in the actuation direction;

moving the plunger in the pumping direction with the force as the plurality of combustion chambers are simultaneously fired; and pumping a media with the plunger.

15. The method of claim 14, wherein the plurality of pistons are hydraulically coupled to a primary piston.

16. The method of claim 15, wherein pumping the media further comprises pumping the media through a borehole completion system.

17. The method of claim 16, wherein pumping the media includes hydraulically fracturing a downhole formation through which the borehole is formed.

18. The method of claim 14, further comprising determining with a control unit a number of the combustion chambers to fire in response to measured parameters, and firing only the number of combustion chambers.

19. The method of claim 18, wherein the determining is performed before each stroke of the plunger in the pumping direction.

* * * * *